US007577268B2

(12) United States Patent
Fischer

(10) Patent No.: US 7,577,268 B2
(45) Date of Patent: Aug. 18, 2009

(54) STABILIZATION OF THE SYSTEM CLOCK IN A HEARING AID

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 826 days.

(21) Appl. No.: 11/194,932

(22) Filed: Aug. 2, 2005

(65) Prior Publication Data

US 2006/0023906 A1 Feb. 2, 2006

(30) Foreign Application Priority Data

Aug. 2, 2004 (DE) ..... 10 2004 037 379

(51) Int. Cl.
*H04R 25/00* (2006.01)

(52) U.S. Cl. ..... 381/315; 381/312; 381/314

(58) Field of Classification Search ..... 381/312, 381/314, 315, 320, 321; 455/3.06
See application file for complete search history.

(56) References Cited

U.S. PATENT DOCUMENTS 5,537,102 A * 7/1996 Pinnow ..... 340/5.8
6,870,940 B2 3/2005 Meyer et al.
7,421,085 B2 * 9/2008 Husung et al. ..... 381/312
2004/0190737 A1 * 9/2004 Kuhnel et al. ..... 381/312
2005/0036637 A1 * 2/2005 Janssen ..... 381/315
2005/0281424 A1 * 12/2005 Rass ..... 381/312
2006/0015245 A1 * 1/2006 Janssen ..... 701/117

FOREIGN PATENT DOCUMENTS

DE 100 48 341 C1 4/2002

* cited by examiner

*Primary Examiner*—Brian Ensey
*Assistant Examiner*—Jasmine Pritchard

(57) ABSTRACT

As a result of the intended miniaturization of digital hearing aids, a quartz crystal cannot be used for generating the system clock. The inaccuracy of the system clock resulting therefrom cannot be tolerated in certain filter applications. It is thus proposed to adhere more precisely to the target value of the clock frequency of the system clock emitted by a clock generator by means of an externally generated clock signal. The external clock signal which can be generated for example in a remote controller for the hearing aid and can be transmitted wirelessly to the hearing aid is used to examine and if necessary readjust the system clock of the hearing aid. In this way, a relatively more precise and stable system c lock can be adhered to at least across more lengthy time segments and without the use of a quartz crystal in the hearing aid.

9 Claims, 1 Drawing Sheet

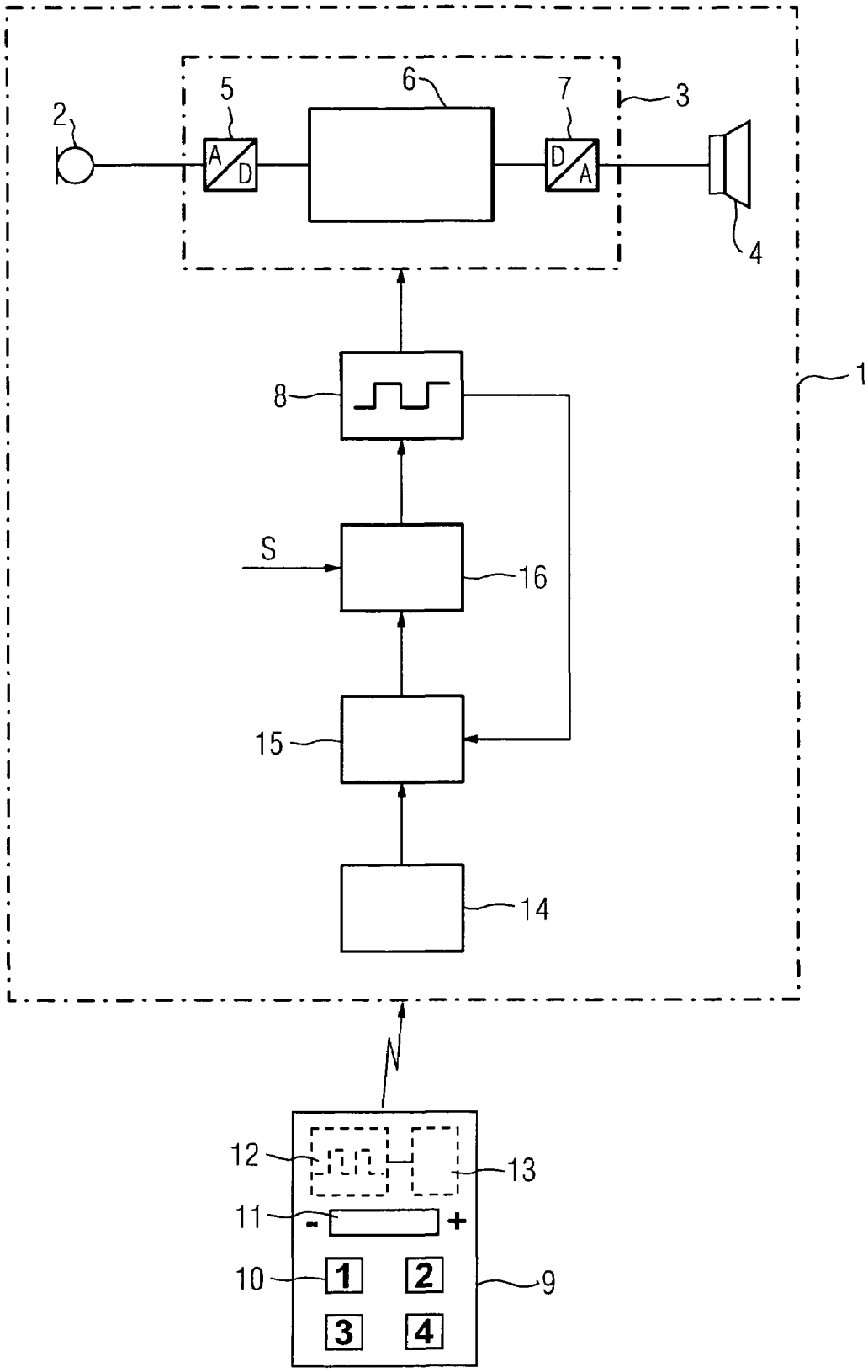
2
5
A
D
6
7
D
A
3
4
1
8
S
16
15
14
12
13
11
-
+
10
1
2
3
4
9

STABILIZATION OF THE SYSTEM CLOCK IN A HEARING AID

CROSS REFERENCE TO RELATED APPLICATIONS

This application claims priority to the German application No. 10 2004 037 379.5, filed Aug. 2, 2004 which is incorporated by reference herein in its entirety.

FIELD & BACKGROUND OF INVENTION

The invention relates to a hearing aid with a input converter for recording an input signal and converting said signal into an electrical input signal, a signal processing unit for processing and frequency-dependent amplification of the electrical input signal, an output converter for generating an output signal which can be perceived by a user as an acoustic signal, and a clock element for generating a system clock, in which the actual system clock frequency of a predetermined system clock frequency deviates within a specific limits of variation from the predetermined system clock frequency in a component-specific manner. The invention further relates to a hearing aid system with a hearing aid of this type and an external transmitter. The invention further relates to a method for operating a hearing aid of this type.

SUMMARY OF INVENTION

In portable digital hearing aids which can be worn behind or in the ear, the proposed miniaturization of the system clock prevents the system clock from being generated with a quartz crystal, but instead solely with an oscillator, since a quartz crystal controller takes up too much space. As a result of the higher, at times temperature-dependent component tolerances, the limits of variation within which the clock frequency of the hearing aid can deviate from a predetermined target value, can thus amount to +/−5%, in other words, with a nominal 20 KHz, the actual value can lie between 19 KHz and 21 KHz. This causes problems above all for filters, which are intended to modify the purely acoustic/physical phenomena, e.g. hearing resonances, effects through the sound tube or the like. In the case of a digital realization, the parameters of this filter, e.g. the frequency path, are directly dependent on the scanning rate of the input signal and thus on the clock frequency. If for instance a small receiver resonance with 8 KHz issued physically through the receiver, is dampened with a digital filter, an inaccurate scanning rate would only allow specifications for a target frequency range of 8 KHz +/−5%, thus 7.6 KHz to 8.4 KHz. This is however too inaccurate. This is the reason why filters of this type have hitherto not been used.

A hearing aid is known from DE 100 48 341 C1, in which an automatic selection of the active hearing program takes place as a function of the time of day. The hearing aid is thus equipped with an internal clock. To ensure an accurate and comfortable adjustment of the current time of day, the hearing aid is preferably configured to receive an external time signal (e.g. DCF 77) of a time signal transmitter. This therefore dispenses with the need for a manual adjustment of the time of day, e.g. the changeover from summer time to winter time.

EP 1 104 645 B1 discloses a hearing aid with a microphone, a signal processing unit, a receiver and a detector element to determine electromagnetic interferences signals, in which a configurable filter element which is dependent on the detected interference signals is present to suppress the interference signal. The known hearing is designed in digital circuitry and therefore comprises a clock generator. With a detected, clocked interference signal, the current clock frequency is replaced by the clock frequency of the interference signal or a multiple of this clock frequency. The clock frequency is thus determined by the clock frequency of the interference signal.

An object of the present invention is to reduce the limits of variation of a predetermined clock signal in the case of a digital hearing aid.

This object is achieved with a hearing aid, an input converter for recording an input signal and converting said signal into an electrical input signal, a signal processing unit for processing and frequency-dependent amplification of the electrical input signal and an output converter for generating an output signal which can be perceived by a user as an acoustic signal and with a clock element for generating a system clock, in which the current system clock frequency of predetermined system clock frequency deviates within a specific limit of variation of the predetermined system clock frequency, in a component-specific manner, by means of an externally generated, periodical electromagnetic signal which can be received in the hearing aid for stabilizing the actual system clock frequency, which can be used such that the deviation of the actual system clock frequency reduces from the predetermined system clock frequency.

The object is further achieved by a method for operating a hearing aid with an input converter for recording an input signal and converting said signal into an electrical input signal, a signal processing unit for processing and frequency-dependent amplification of the electrical input signal and an output converter for generating an output signal which can be perceived by a user as an acoustic signal and a clock element for generating a system clock, in which the actual system clock frequency of a predetermined system clock frequency deviates within a specific limits of variation from the predetermined system clock frequency in a component-specific manner, with the following steps: Receiving a periodic electromagnetic signal of an external transmitter, the period of which is known, Counting the actual clock pulses of the system clock of the hearing aid during at least one period of the signal emitted by the external transmitter. Comparing the counter results with a target value Readjusting the system clock to adapt the actual number of clock pulses during a period of the signal emitted by the external transmitter to a target value.

In a hearing aid an input signal is recorded by means of an input converter and converted into an electrical input signal. Typically at least one microphone which records an acoustic input signal serves as an input converter. Modern hearing aids frequently comprise a microphone system with a number of microphones in order to achieve a receipt dependent on the incidence direction of acoustic signals, a directional characteristic. The input converters can nevertheless also comprise a telephone coil or an antenna for recording electromagnetic input signals. The input signals converted into electrical input signals by means of the input converter are supplied to a signal processing unit for further processing and amplification. To compensate for the individual hearing loss of a hearing aid wearer, the further processing and amplification generally takes place as a function of the signal frequency. The signal processing unit emits an electrical output signal which is supplied to the ear of the hearing aid wearer by means of an output converter, so that the wearer perceives the output signal as an acoustic signal. Earpieces are typically used as output converters, which generate an acoustic output signal. Output converters however are also known for generating mechanical variations which directly cause specific parts of the ear to vibrate, the ossicles for instance. Output converters are further known which directly stimulate the nerve cells in the ear.

The hearing aid according to the invention employs digital circuitry in its design and thus comprises a clock element for generating the system clock. Since a quartz crystal can not be used as a result of the intended miniaturization of hearing aids, a conventional oscillator is used with the hearing aid according to the invention. This is however disadvantageous in that a predetermined system clock frequency can actually only be achieved with a variation of approximately +/−5% of the predetermined value. Since this variation is not acceptable for use with specific filters, it is proposed according to the invention to use a more precise, e.g. stabilized with quartz crystal, external clock signal for stabilizing the internal system clock. This clock signal is generated in an external device, for example a remote control for the hearing aid and is transmitted wirelessly as an electromagnetic signal to the hearing aid. If the clock frequency of this external clock is known, the clock frequency of the hearing aid can thus be compared and readjusted. The variation from the predetermined value is therefore considerably smaller than +/−5%, by way of example still only +/−0.5%. The stabilized clock with the low variation of the clock frequency from the target value thus achieved allows digital filters implemented in the hearing aid to be far more precisely adjusted.

A so-called ring oscillator which is characterized by its particularly low power consumption is frequently used in hearing aids to generate the clock. This is essentially designed from a number of successively switched inverters, in which the output of the last inverter of the chain is fed back to the input of the first inverter. The clock is finely adjusted by means of an adjustable power source which supplies the inverter with power. The current of this power source is typically adjusted once after the production of a hearing aid. During the operation of the hearing aid, the environmental temperature, ageing influences, component tolerances etc result nevertheless in the above-mentioned variations of up to +/−5% from the set target value. In conjunction with the invention, this method of the clock generation allows the power source to be re-adjusted during the operation of the hearing aid.

The invention is not restricted to the ring oscillator for clock generation given as an example. In fact, a plurality of further methods for clock generation is known in hearing aids. Even with known further methods, the clock frequency can generally be re-adjusted by controllable current or voltage sources, resistances, capacitances or inductances.

An exemplary embodiment of the invention provides for a quartz crystal watch as an external transmitter, which is additionally provided with a transmission unit. In comparison with conventional quartz crystal watches, this only requires insignificant modifications and can be worn unobtrusively at the required distance from the hearing aid specific for this deployment.

In a preferred embodiment of the invention, a time signal for radio clocks transmitted in many countries, in Germany the DCF77 time signal, is used as an external clock signal, in order thus to stabilize the hearing aid internal system clock. A time signal of this type is emitted in a number of countries giving full coverage and with high level of accuracy of the clock periods. Corresponding receivers are available at low cost.

There is provision in further embodiment of the invention for re-adjustment of the system clock, for averaging over a number of counts of the actual clock pulses of the hearing aid clock during at least one period of the external clock signal and for performing the corresponding comparisons with the target value, in order to re-adjust the system clock. In this way a more precise adjustment of the system clock is achieved. Interferences during the receipt of the external signal are thus balanced out.

BRIEF DESCRIPTION OF DRAWINGS

FIG. 1 is a schematic illustration of a hearing and external transmitter.

DETAILED DESCRIPTION OF INVENTION

The invention is described in more detail below, with reference to an exemplary embodiment. For this embodiment the figure shows a hearing aid 1 with a microphone 2 for recording an acoustic input signal and converting said signal into an electrical signal, a signal processing unit 3 for processing and frequency-dependent amplification of the electrical signal and a receiver 4 for converting the processed and amplified signal into an acoustic output signal which is supplied to the ear of a hearing aid wearer. The signal processing unit 3 in the exemplary embodiment is designed as a digital circuit and thus comprises an A/D converter for converting the electrical input signal into a digital input signal as well as a D/A converter 7 for converting the processed, digital signal into an analog output signal. Between these two converters the signal is processed in a signal processing unit 6 realized in digital circuitry.

The digital components of the hearing aid 1 are clocked by means of a clock generator 8. Individual components can also be clocked with multiples of this clock frequency by means of frequency reproducers. Since the clock generator only contains one simply designed oscillator and no quartz crystal, the predetermined clock frequency can be observed using a maximum variation of +/−5% from the predetermined target value. This limit of variation is nevertheless too high for specific digital filters contained in the digital signal processing unit 6.

The clock frequency generated by the clock generator 8 is stabilized according to the invention such that the variation of up to +/−5% of the target value is essentially at least partially limited. For this purpose, a remote controller 9 serves to remotely control the hearing aid 1 in the exemplary embodiment. This comprises the program selection key 10 labeled with, 1' to, 4' for the adaptation of the signal processing in the hearing aid 1 to different hearing environments as well as a loudspeaker rocker switch 11 for adjusting the volume. In addition to these conventional components in a remote controller, the remote controller 9 in the exemplary embodiment comprises a clock generator 12 with a quartz crystal 13. The clock frequency can thus be very accurately observed. The periods of the clock pulse which are generated and emitted by the remote controller 1 is preferably very long, 10 seconds for example. In this way, hardly any energy is required to transmit the clock signal. The hearing aid 1 comprises a receiving unit 14 on its side for receiving the clock signal outputted by the remote controller 9. The external clock signal is them supplied to a counter 15, which counts the number of clocks in the clock generator 8 during a period of the external clock signal, e.g. the counter 15 achieve a counter reading of 210.00 during a period of the external clock signal of 10 seconds. With a target value of the system clock frequency of 20 KHz, the counter reading must amount nevertheless to 200.000 after 10 seconds. The clock frequency of the clock generator 8 is thus correspondingly readjusted. A comparison control unit 16 is thus present in the hearing aid 1, into which a target value S is input in addition to the counter reading. From the comparison of the counter reading with the target value, the comparison and control unit 16 generates a control signal in order to slow down the clock frequency in the clock generator 8.

With a preferred embodiment of the invention, the counter reading is averaged over several periods of the external clock signal before a control signal for correcting the clock frequency of the clock generator 8 is generated. In this way, a far more precise adjustment of the system clock of the hearing aid 1 is achieved. In particular, interferences during the receipt of the external clock signal are balanced out.

The invention claimed is:

1. A hearing aid, comprising:

an input converter for acquiring an acoustic input signal and converting the acoustic input signal into an electrical input signal;

a signal processing unit for processing and amplifying the electrical input signal, the amplifying being frequency-selective;

an output converter for generating an acoustic output signal perceivable by a user of the hearing aid;

a clock generator for generating a system clock, a frequency of the system clock varying within a specific frequency variation range from a desired system clock frequency, the frequency variation range characteristic for the hardware associated with the clock generator; and a signal receiver for receiving a periodic electromagnetic signal originating from an external source, the periodic electromagnetic signal configured to stabilize the frequency of the system clock thus reducing the variation of the frequency of the system clock from the desired system clock frequency.

2. A hearing aid system, comprising a hearing aid, the hearing aid comprising:

an input converter for acquiring an acoustic input signal and converting the acoustic input signal into an electrical input signal;

a signal processing unit for processing and amplifying the electrical input signal, the amplifying being frequency-selective;

an output converter for generating an acoustic output signal perceivable by a user of the hearing aid;

a clock generator for generating a system clock, a frequency of the system clock varying within a specific frequency variation range from a desired system clock frequency, the frequency variation range characteristic for the hardware associated with the clock generator;

a signal receiver for receiving a periodic electromagnetic signal, the periodic electromagnetic signal configured to stabilize the frequency of the system clock thus reducing the variation of the frequency of the system clock from the desired system clock frequency; and a transmitter for generating the periodic electromagnetic signal.

3. The hearing aid system according to claim 2, further comprising a remote control for controlling the hearing aid, wherein the transmitter is included in the remote control.

4. The hearing aid system according to claim 2, wherein the transmitter comprises a quartz crystal for generating the periodic electromagnetic signal.

5. The hearing aid system according to claim 4, further comprising a quartz watch including the quartz crystal.

6. The hearing aid system according to claim 2, wherein the transmitter is a time signal-transmitter for synchronizing radio-controlled clocks.

7. The hearing aid system according to claim 6, wherein the time signal-transmitter emits a DCF77 time signal.

8. A method for operating a hearing aid, the hearing aid comprising:

an input converter for acquiring an acoustic input signal and converting the acoustic input signal into an electrical input signal;

a signal processing unit for processing and amplifying the electrical input signal, the amplifying being frequency-selective;

an output converter for generating an acoustic output signal perceivable by a user of the hearing aid;

a clock generator for generating a system clock, a frequency of the system clock varying within a specific frequency variation range from a desired system clock frequency, the frequency variation range characteristic for the hardware associated with the clock generator; and a signal receiver for receiving a periodic electromagnetic signal originating from an external source, the periodic electromagnetic signal configured to stabilize the frequency of the system clock thus reducing the variation of the frequency of the system clock from the desired system clock frequency, the method comprising:

receiving the periodic electromagnetic signal from the external source by the signal receiver, a period of the periodic electromagnetic signal being predetermined;

counting an actual number of clock pulses generated by the system clock during at least one period of the periodic electromagnetic signal;

comparing the counted actual number of clock pulses to a target number of clock pulses; and adjusting the system clock to generate substantially the target number of clock pulses based on the difference between the counted actual number of clock pulses and the target number of clock pulses.

9. The method according to claim 8, wherein the counted actual number of clock pulses is determined by averaging over a plurality of counted actual number of clock pulses.

* * * * *